US006064359A

United States Patent [19]

Lin et al.

[11] Patent Number: 6,064,359

[45] Date of Patent: May 16, 2000

[54] FRAME RATE MODULATION FOR LIQUID CRYSTAL DISPLAY (LCD)

[75] Inventors: Tsung-Nan Lin; Joseph Shu, both of San Jose, Calif.; Jerzy Wieslaw Swic, Vancouver, Canada

[73] Assignee: Seiko Epson Corporation, Tokyo, Japan

[21] Appl. No.: 09/048,131

[22] Filed: Mar. 25, 1998

Related U.S. Application Data

[63] Continuation-in-part of application No. 08/890,611, Jul. 9, 1997.

[51] Int. Cl.[7] ..... G09G 3/36

[52] U.S. Cl. ..... 345/89; 345/147; 345/148; 345/149; 358/455; 358/457

[58] Field of Search ..... 345/89, 147, 148, 345/149; 358/455, 457

[56] References Cited

U.S. PATENT DOCUMENTS

| | | | |
|---|---|---|---|
| 4,921,334 | 5/1990 | Akodes . | |
| 5,014,124 | 5/1991 | Fujisawa | 358/75 |
| 5,068,649 | 11/1991 | Garrett . | |
| 5,111,194 | 5/1992 | Oneda | 340/793 |
| 5,122,783 | 6/1992 | Bassetti, Jr. . | |
| 5,245,328 | 9/1993 | Garrett . | |
| 5,301,269 | 4/1994 | Alcorn et al. | 395/158 |
| 5,313,224 | 5/1994 | Singhal et al. . | |
| 5,389,948 | 2/1995 | Liu . | |
| 5,642,133 | 6/1997 | Scheffer et al. . | |
| 5,659,331 | 8/1997 | Oh et al. . | |
| 5,712,657 | 1/1998 | Eglit et al. . | |
| 5,714,974 | 2/1998 | Liu . | |

FOREIGN PATENT DOCUMENTS

| | | |
|---|---|---|
| WO 89/06851 | 7/1989 | WIPO . |
| WO 90/03023 | 3/1990 | WIPO . |
| WO 90/12388 | 10/1990 | WIPO . |

*Primary Examiner*—Richard A. Hjerpe
*Assistant Examiner*—Kimnhung Nguyen
*Attorney, Agent, or Firm*—Mark P. Watson

[57] ABSTRACT

The gray shade rendering capability of a display device having a frame rate of q frames per display cycle is enhanced by comparing an intensity value representing a gray shade of a current pixel with a respective dither matrix threshold value and providing a pixel on/off signal, storing a plurality of quantization values ranging from 1 to q in a quantization table, outputting p quantization values from the quantization table as active quantization values in accordance with a quantized pixel value p, shifting the quantization values in the table in response to a frame signal, comparing a quantized dither matrix threshold value to the active quantization values and producing an active quantized threshold signal, producing a pixel out signal in response to the pixel on/off signal and the active quantized threshold signal, and in response to the pixel out signal displaying the current pixel with an average gray value of p/q through a display period of q frames.

38 Claims, 14 Drawing Sheets

| | | | | | | | | | | | | | | | |
|---|---|---|---|---|---|---|---|---|---|---|---|---|---|---|---|
| 129 | 21 | 163 | 213 | 23 | 175 | 140 | 26 | 193 | 253 | 62 | 24 | 111 | 244 | 58 | 217 |
| 239 | 96 | 55 | 120 | 240 | 98 | 67 | 228 | 50 | 126 | 153 | 230 | 78 | 170 | 144 | 27 |
| 76 | 204 | 151 | 37 | 191 | 3 | 161 | 182 | 105 | 16 | 215 | 44 | 201 | 7 | 107 | 186 |
| 164 | 15 | 233 | 128 | 80 | 216 | 121 | 35 | 208 | 143 | 73 | 174 | 130 | 90 | 227 | 46 |
| 247 | 69 | 102 | 180 | 47 | 145 | 255 | 61 | 87 | 238 | 114 | 30 | 248 | 57 | 154 | 113 |
| 34 | 139 | 194 | 8 | 231 | 94 | 18 | 158 | 199 | 9 | 156 | 190 | 93 | 211 | 1 | 200 |
| 127 | 219 | 56 | 165 | 72 | 202 | 116 | 181 | 49 | 101 | 221 | 64 | 19 | 135 | 177 | 82 |
| 159 | 22 | 250 | 108 | 142 | 39 | 237 | 79 | 138 | 243 | 38 | 147 | 229 | 106 | 252 | 48 |
| 99 | 179 | 88 | 2 | 226 | 169 | 29 | 218 | 0 | 124 | 183 | 83 | 167 | 33 | 70 | 209 |
| 234 | 42 | 136 | 207 | 122 | 63 | 100 | 148 | 173 | 71 | 210 | 10 | 119 | 195 | 149 | 14 |
| 117 | 192 | 74 | 155 | 17 | 188 | 254 | 54 | 197 | 32 | 97 | 251 | 51 | 225 | 86 | 172 |
| 212 | 25 | 246 | 53 | 222 | 85 | 134 | 20 | 112 | 224 | 157 | 131 | 176 | 28 | 137 | 59 |
| 92 | 162 | 103 | 178 | 115 | 36 | 205 | 166 | 249 | 84 | 60 | 13 | 203 | 109 | 245 | 5 |
| 232 | 65 | 141 | 4 | 235 | 152 | 68 | 104 | 43 | 184 | 125 | 236 | 89 | 66 | 150 | 185 |
| 31 | 206 | 41 | 187 | 91 | 198 | 11 | 220 | 146 | 6 | 214 | 40 | 160 | 223 | 45 | 123 |
| 171 | 110 | 241 | 75 | 132 | 52 | 242 | 118 | 77 | 168 | 95 | 189 | 133 | 12 | 196 | 81 |

FIG. 3

| | | | | | | | | | | | | | | | |
|---|---|---|---|---|---|---|---|---|---|---|---|---|---|---|---|
| 3 | 1 | 4 | 5 | 1 | 4 | 3 | 1 | 4 | 5 | 2 | 1 | 3 | 5 | 2 | 5 |
| 5 | 2 | 2 | 3 | 5 | 2 | 2 | 5 | 1 | 3 | 3 | 5 | 2 | 4 | 3 | 1 |
| 2 | 4 | 3 | 1 | 4 | 1 | 4 | 4 | 3 | 1 | 5 | 1 | 4 | 1 | 3 | 4 |
| 4 | 1 | 5 | 3 | 2 | 5 | 3 | 1 | 5 | 3 | 2 | 4 | 3 | 2 | 5 | 1 |
| 5 | 2 | 2 | 4 | 1 | 3 | 5 | 2 | 2 | 5 | 3 | 1 | 5 | 2 | 4 | 3 |
| 1 | 3 | 4 | 1 | 5 | 2 | 1 | 4 | 4 | 1 | 4 | 4 | 2 | 5 | 1 | 4 |
| 3 | 5 | 2 | 4 | 2 | 4 | 3 | 4 | 1 | 2 | 5 | 2 | 1 | 3 | 4 | 2 |
| 4 | 1 | 5 | 3 | 3 | 1 | 5 | 2 | 3 | 5 | 1 | 3 | 5 | 3 | 5 | 1 |
| 2 | 4 | 2 | 1 | 5 | 4 | 1 | 5 | 1 | 3 | 4 | 2 | 4 | 1 | 2 | 5 |
| 5 | 1 | 3 | 5 | 3 | 2 | 2 | 3 | 4 | 2 | 5 | 1 | 3 | 4 | 3 | 1 |
| 3 | 4 | 2 | 4 | 1 | 4 | 5 | 2 | 4 | 1 | 2 | 5 | 1 | 5 | 2 | 4 |
| 5 | 1 | 5 | 2 | 5 | 2 | 3 | 1 | 3 | 5 | 4 | 3 | 4 | 1 | 3 | 2 |
| 2 | 4 | 3 | 4 | 3 | 1 | 5 | 4 | 5 | 2 | 2 | 1 | 4 | 3 | 5 | 1 |
| 5 | 2 | 3 | 1 | 5 | 3 | 2 | 3 | 1 | 4 | 3 | 5 | 2 | 2 | 3 | 4 |
| 1 | 5 | 1 | 4 | 2 | 4 | 1 | 5 | 3 | 1 | 5 | 1 | 4 | 5 | 1 | 3 |
| 4 | 3 | 5 | 2 | 3 | 2 | 5 | 3 | 2 | 4 | 2 | 4 | 3 | 1 | 4 | 2 |

FIG. 4

| | | | | | | | | |
|---|---|---|---|---|---|---|---|---|
| 0.0008 | 0.0039 | 0.0117 | 0.0229 | 0.0286 | 0.0229 | 0.0117 | 0.0039 | 0.0008 |
| 0.0039 | 0.0183 | 0.0556 | 0.1084 | 0.1353 | 0.1084 | 0.0556 | 0.0183 | 0.0039 |
| 0.0117 | 0.0556 | 0.1690 | 0.3292 | 0.4111 | 0.3292 | 0.1690 | 0.0556 | 0.0117 |
| 0.0229 | 0.1084 | 0.3292 | 0.6412 | 0.8007 | 0.6412 | 0.3292 | 0.1084 | 0.0229 |
| 0.0286 | 0.1353 | 0.4111 | 0.8007 | 1.0000 | 0.8007 | 0.4111 | 0.1353 | 0.0286 |
| 0.0229 | 0.1084 | 0.3292 | 0.6412 | 0.8007 | 0.6412 | 0.3292 | 0.1084 | 0.0229 |
| 0.0117 | 0.0556 | 0.1690 | 0.3292 | 0.4111 | 0.3292 | 0.1690 | 0.0556 | 0.0117 |
| 0.0039 | 0.0183 | 0.0556 | 0.1084 | 0.1353 | 0.1084 | 0.0556 | 0.0183 | 0.0039 |
| 0.0008 | 0.0039 | 0.0117 | 0.0229 | 0.0286 | 0.0229 | 0.0117 | 0.0039 | 0.0008 |

FIG. 11

FRAME RATE MODULATION FOR LIQUID CRYSTAL DISPLAY (LCD)

Related Applications

This application is a continuation-in-part of pending, prior application Ser. No. 08/890,611 filed Jul. 9, 1997, which is incorporated herein in its entirety by reference.

BACKGROUND OF THE INVENTION

1. Field of the Invention

This invention relates generally to display devices and more particularly to display devices in which only two states (on/off) or a limited number of discrete states are selectable for each picture element (pixel). More particularly, the present invention is to related to methods and apparatus for enhancing the gray shade rendering capability of a display device such as a liquid crystal display.

2. Description of the Related Art

Various devices for image display are available and their display capabilities vary greatly. For example, on a CRT display light is produced by three primary phosphors, red, green and blue (RGB), which are excited separately by the electron beam in the CRT. Through the application of a varying intensity electron beam to each of the adjoining red, green and blue phosphors (forming each pixel) a large gamut of colors and brightness levels can be produced. Color images are often represented as an array of pixels with the value of each pixel being represented by a 24-bit word, i.e. one 8-bit byte per color component. Each color component for each pixel can be represented by an intensity value ranging from 0 to 255. Color images (e.g. computer generated) for display on a CRT may include a large number of colors within this gamut or range.

In comparison to CRTs, liquid crystal displays (LCDs) have far less precision and may be limited to binary (on/off) with one bit per pixel or perhaps as many as four bits per pixel. LCDs have the capability to produce far fewer colors or shades of gray than can be represented by 8-bit pixel precision. LCDs are generally comprised of flat panels that are formed of a liquid crystal substance filling a clearance between two substrates. Images are displayed by controlling the orientation of the liquid crystal substance by an external signal to modulate the light, allowing it to pass through the panel or blocking it. Individual pixels are arranged in a matrix or array and are driven by a plurality of scanning electrodes and data electrodes. Generally, each pixel is controlled to be completely on or completely off (binary). In some devices intermediate gray levels can be depicted by applying incremental cell voltages that fall between full on and full off. However, there are practical limits on the generation and maintenance of such intermediate voltage levels. Color images can be produced in LCD displays through the use of color filter mosaics in registration with the individual pixel electrodes or using a white light separated by optics, such as dichroic mirrors, into red, green and blue components, which are modulated by the LCD panel.

In order to attempt to faithfully depict an image with a relatively high precision (e.g. 8-bits/pixel) on an LCD device, there must be an increase in the number of visually perceivable gray scale brightness levels. One approach is frame rate cycling or frame rate modulation in which a pixel is driven alternately on and off across multiple frame refreshes to produce a visual effect of the average intensity over the pattern cycle. For example, if a pixel is turned on during three frame refreshes and off for two it will appear to have a gray scale intensity of ⅗ for that refresh cycle. This approach can have drawbacks such as perceived flicker (where the image appears to be rapidly turned on and off) or swim (where the image appears to have artificial patterns that pass through it).

Various attempts have been made to reduce these visual drawbacks. For example, U.S. Pat. No. 5,642,133 to Scheffer et al. provides a number of gray levels for an LCD by modulating the amplitude or pulse height of the display column drive signals. However, such system requires multilevel drivers. U.S. Pat. No. 5,313,224 to Singhal et al. attempts to reduce flicker by spreading the phases of the modulating pixels across time and across the horizontal and vertical axes of the display. U.S. Pat. No. 4,921,334 to Akodes is one example which utilizes a combination of a multilevel driver and time multiplexing between successive frames. U.S. Pat. No. 5,608,649 to Garrett attempts to reduce flicker using an indiscernible pattern to cycle between on and off states. U.S. Pat. No. 5,389,948 to Liu varies the illumination of each pixel in accordance with the gray value of the corresponding pixel in the original image, the frame number, and the value of an element in a dither matrix. While these prior art methods may be helpful in reducing flicker or visual artifacts, they are limited in their ability to provide uniform dot patterns or a large number of gray shades.

OBJECTS OF THE INVENTION

Therefore, it is an object of the present invention to overcome disadvantages in conventional systems for rendering gray shades in a limited precision display device.

In particular, an object of the present invention is to provide an improved system for displaying images on a liquid crystal display (LCD) device.

Another object of the present invention is to provide an improved system for frame rate modulating an LCD device to reduce flicker and visual artifacts.

A further object of the present invention is to increase the number of gray shades that can be depicted on a binary display device.

A still further object of the present invention is to provide a uniform dot pattern in each frame of the frame rate modulated image.

SUMMARY OF THE INVENTION

The present invention utilizes a dispersed dither matrix to generate very uniform dot patterns. This matrix is generated using a frequency-modulation or dispersed-dot screening approach. An exemplary 16×16 dispersed dither matrix is shown in FIG. 3.

In order to generate a gray shade of p/q, we first generate a linear quantization table of levels from 1 to q according the number of frames or frame refreshes q per display period. At time t(1), the first p entries in the quantization table are selected for activation. At each subsequent time t(2), t(3) . . . t(q), the contents of the quantization table are circularly shifted, and the first p entries in the quantization table following the shift are selected. For example, to generate a gray shade of 3/5, the quantization table as shown in FIG. 5 is generated. For each frame the first 3 entries in the table are active. As time passes, the quantization levels in these first 3 entries will change as shown in FIG. 5. The active levels in 5 frames will be in sequence (1, 2, 3), (4, 5, 1), (2, 3, 4), (5, 1, 2), and (3, 4, 5). With this method, three levels will be active during any frame but the particular levels selected for activation will vary from frame to frame.

The active quantization levels are mapped through a dispersed dither matrix, such as that shown in FIG. 3, to generate the corresponding pattern sequences that will be displayed in the LCD panel to render different gray shades. The dither matrix (e.g. FIG. 3) is quantized to q levels (e.g. 5) based on the rank of each entry in the matrix. This results in the quantized matrix shown in FIG. 4. A pixel is either on or off depending on whether its corresponding quantization level is active or not. In the example of a gray shade of 3/5, the matrix is quantized into 5 different levels according to the rank of each element. The active levels are generated through 5 frames in sequence as shown in FIG. 5. The shifted versions of the active levels are mapped though the quantized matrix resulting in corresponding pattern sequences. Due to the selection of the matrix in FIG. 3, which maximizes uniformity in dot distribution, the patterns generated will have uniformity in every frame.

Other objects and attainments together with a fuller understanding of the invention will become apparent and appreciated by referring to the following description and claims taken in conjunction with the accompanying drawings.

BRIEF DESCRIPTION OF THE DRAWINGS

In the drawings wherein like reference symbols refer to like parts

FIG. 3 shows the threshold values of an exemplary dither matrix of the present invention;

FIG. 4 shows the dither matrix of FIG. 3 quantized to five levels;

FIG. 11 is a diagram of a Gaussian kernel used to assess void size;

DESCRIPTION OF THE PREFERRED EMBODIMENTS

Figure 1C:
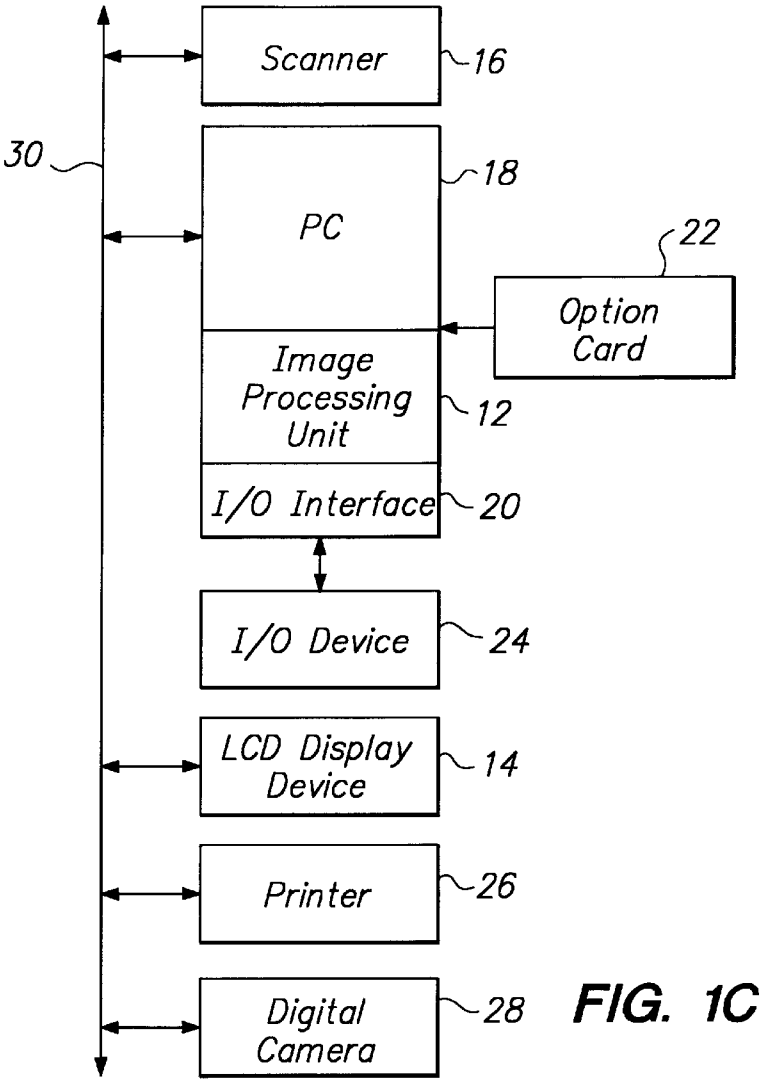
FIGS. 1A, 1B and 1C are block diagram representations of various general configurations of the environment of the present invention.
Figure 1A:
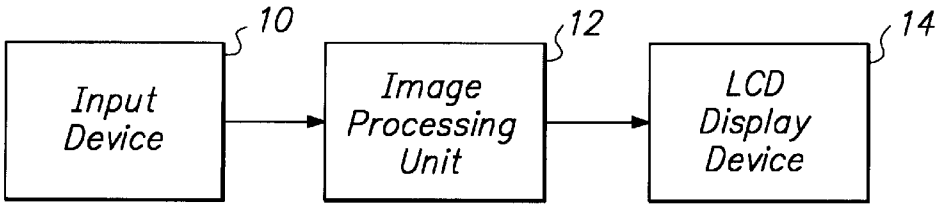
Figure 1B:
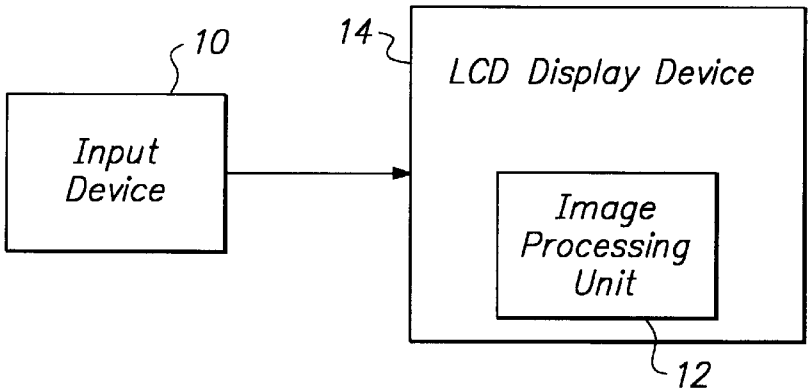

Reference is now made to FIGS. 1A, 1B and 1C which show general block diagrams of the environment of the present invention. A source image S is output from an image generating device or input device 10, which may be, for example, a personal computer with graphics producing capability, a digital camera, scanner, etc. The source image may be a still image or a moving image from a video source. The source image is processed by image processing unit 12 and is sent to the LCD display device 14 for display. The LCD display device 14 may be, for example, a panel display for a computer or a projector.

The image processing unit 12 may be implemented in hardware with discrete components, software, firmware, application specific integrated circuits (ASICs), or any combination thereof. Also, the functional blocks of the image processing unit are divided in this specification for convenience of description only. The functional and physical boundaries of these blocks will vary from device to device. For example, FIG. 1B shows the image processing unit physically integrated with the LCD display device 14. Portions of the image processing unit may be associated functionally more with the input device than with the LCD display device or vice versa. FIG. 1C shows an embodiment with the image processing unit formed as part of a personal computer (PC) 18 which may control operation of and communication between the image processing unit 12, LCD display device 14, printer 26, input devices such as scanner 16 and digital camera 28, and control of and communication with peripheral equipment such as I/O device 24, each connected directly or indirectly to a PC Bus 30. In this embodiment, the source image(s) may be have been previously stored (and perhaps enhanced through processing) in an I/O device 24 and can be loaded into the PC through I/O interface 20, or the image may be captured with a digital image input device such as a digital camera 28. In addition, the image processing unit 12, in the form of software, may be loaded into the PC's memory from an external storage device, i.e. I/O device 24. Alternately, the image processing unit in the form of hardware, ASIC, firmware, etc. or combination thereof can be embodied in an option card 22 that can be inserted into an available PC card slot.

While the present invention is applicable to any such device having these basic components, for the sake of illustration only the invention will be described in the environment of a particular image handling unit such as LCD display device 14 shown in FIGS. 2A and 2B. In the exemplary system shown in FIG. 2A, a central processing unit (CPU) 36, which may form part of PC 18, for controlling image processing and other system operations, is coupled to a graphics controller 38 via a bus 40, which may form a part of or be independent of PC bus 30. Graphics controller 38 is coupled to video memory 42, via bus 44, for retrieving image data therefrom, and to LCD display device 14, via bus 46, for supplying image data thereto. Graphics controller 38 sends data signals ($P_{x,y}$) scan line clock signals, frame signals and pixel clock signals on bus 46 to operate LCD device 14. Dither matrix generator 78, the operation of which is discussed hereinafter, is also shown connected to bus 40. Dither matrix generator 78, shown as a separate functional block for discussion purposes, may form part of image processing unit 14 (FIGS. 1A, 1B and 1C), and may be embodied in hardware with discrete components, software, firmware, application specific integrated circuits (ASICs), or any combination thereof.

The source image S may be from a variety of input devices including a personal computer with image generating capability, a scanner, a digital camera, etc. The image may be a digital representation of a document, photograph or a mixed text and graphics image, for example, in the form of a bitmap or combination of bitmaps and is stored in video memory 42, which may be any suitable memory or an assigned area of a memory, e.g. a random access memory (RAM). This stored electronic image comprises a number of discrete samples called pixels (pixel is a contraction of picture element) or pels (pel is a contraction of print element). Each pixel is defined by its position (e.g. x and y coordinates) and intensity. Typically, the precision used for computer storage of images is eight bits per pixel, which permits representation of 256 gray levels. For the purposes of this discussion it will be assumed that the resolution of the input source image S and the resolution of the LCD display are the same. In most instances, however, the source image will have been down-sampled or up-sampled using various filtering techniques to match the resolution of the LCD.

The pixel clock signal keeps track of the x-coordinate of the current pixel and the scan line clock signal keeps track of the y-coordinate of the current pixel whose value (intensity) is carried by the pixel data signals $P_{x,y}$. The frame signal or vertical blanking signal is used to keep track of the count of each display frame within a display time period. The LCD display screen will be refreshed a number of times within a display time period to depict the same image data. The graphics controller will operate the video memory to retrieve new image data for display for each new display time period. This conventional operation may be implemented with frame buffers and first-in first-out (FIFO) buffers as is well known.

The pixel clock signal and scan line clock signal are also used to address dither matrix 48. The dither matrix is an N×N array of dither matrix threshold values. Dither matrix 48 is utilized since, in contrast to the original image in which each pixel may have one of 256 possible values, the typical LCD display can render any single pixel only completely on or completely off (in gray-scale display). Some LCD displays are capable of somewhat finer value quantization, but the quantizations of which even those are capable are almost always coarser than that of the original image. To achieve the illusion of finer gray-scale quantization, we use half-toning, in which the gray level is achieved in a uniform-gray-level region by alternating on pixels with off pixels, the percentage of each depending on the gray-scale effect to be achieved. Of course, most images of interest have regions whose pixel values are not uniform, so there has to be a way to half-tone pixels whose intensity values change from one pixel to the next. A relatively fast way to perform half-toning on such images is known as "dithering."

Dithering involves comparing pixel values with respective threshold values of a dither matrix. For example, let us assume that the dither-matrix size is 16×16 and the image space is 640 pixels by 480 lines. A dithering process involves conceptually laying the dither matrix over each such sub-region of the original image so that each pixel is associated with a respective dither threshold. Comparing a given pixel's image value with its thus-assigned threshold value determines whether the pixel will be on or off. If the image value at a given pixel exceeds that pixel's dither threshold, then the pixel will be on. Otherwise it will be off. The dither-operation output for each pixel is a binary indication of whether that pixel will be on or off. The elements of the dither matrix are mapped into the x-y image coordinate space by modulo counters, i.e. pixel counter 50 and scan line counter 52, such that D(x,y)=D(i,j) for i=x mod N and j=y mod N. The present invention utilizes a novel technique for generating the values of dither matrix 48 using dither matrix generator 78, which will be discussed in some detail hereinafter and which is disclosed in pending related U.S. patent application Ser. No. 08/890,611, filed Jul. 9, 1997, and which is incorporated in its entirety herein by reference. An exemplary 16×16 dither matrix generated by such novel technique is shown in FIG. 3. Such a dither matrix will generate very uniform pixel patterns in the displayed image.

The current pixel $P_{x,y}$ value (i.e. 0–255) is compared with the corresponding dither matrix $D_{i,j}$ value by comparator 54, which will generate one of two values, $P_{dith}$=1 or $P_{dith}$=0. For example, if the current pixel $P_{x,y}$ has a gray value of 150 and the threshold value of the dither matrix location $D_{i,j}$ that maps to that x-y coordinate is 122, then comparator 54 will output the value $P_{dith}$=1. Two separate outputs of comparator 54 are shown for purposes of explanation but a single output $P_{dith}$ which is high (active) for $P_{dith}$=1 and low (inactive) for $P_{dith}$=0 can be implemented. The outputs of comparator 54 are input to pixel out generator 56 (FIG. 2B), which will be described hereinafter.

In order improve the visual effect of the displayed image, frame rate modulation is employed in the present invention to expand the gray shades represented by the LCD display. The frame rate or frequency at which the LCD is refreshed will vary from device to device. In a frame modulated system, the pixels forming the image on the display are turned on and off in different frames in correlation with the gray level or shade of color to be depicted. In the present discussion, the number of frames per display period will be denoted as q. As an example, assume the display is refreshed 5 times per period (q=5) and an area of the display has an effective gray shade of 3/5 (e.g. 121/255 quantized to 5 displayable gray levels). If all the pixels in the area of interest were simply turned on for the first three frames and off for the next two there would be a very perceptible flicker. Varying the pattern of on and off pixels over time while maintaining the proportion of on and off pixels helps to reduce distracting effects.

Figure 2A:
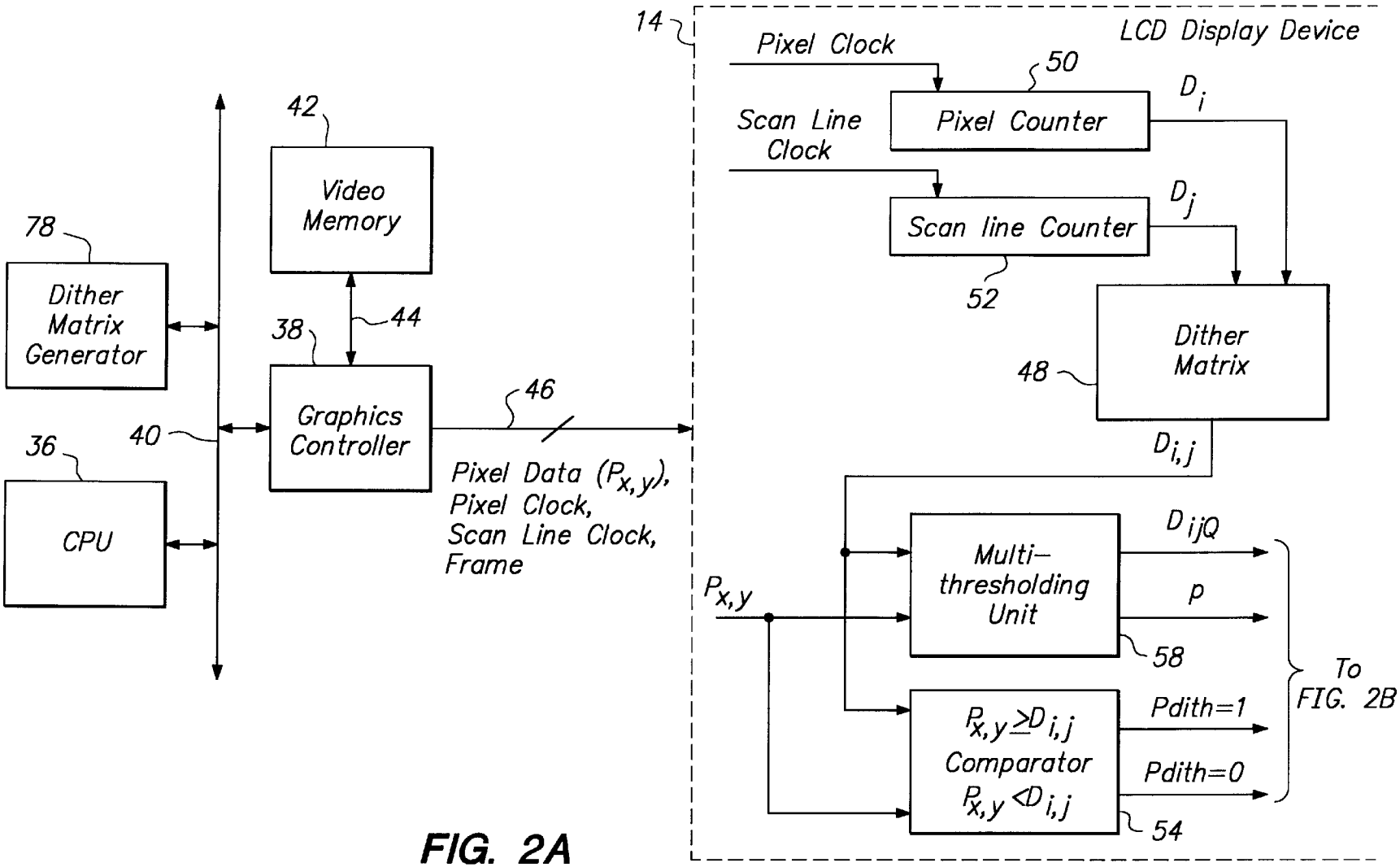
FIGS. 2A and 2B together form a schematic block diagram of the major functional components of the present invention.

With reference to FIG. 2A, in the present invention the dither matrix threshold value $D_{i,j}$ is also input to multi-thresholding unit 58 that quantizes the value according to the frame rate or number of frames per display period. For example, if there are five frames per frame period (q=5) the threshold value will be quantized to a value of 1, 2, 3, 4 or 5. FIG. 4 shows a quantized representation of the dither matrix illustrated in FIG. 3 quantized to five levels. The output of the multi-thresholding unit 58 is a quantized dither matrix value $D_{ijQ}$. This value is input to active level comparator 60 (FIG. 2B), which compares the quantized dither matrix value $D_{ijQ}$ to the active entries in quantization table 62.

Figure 2B:
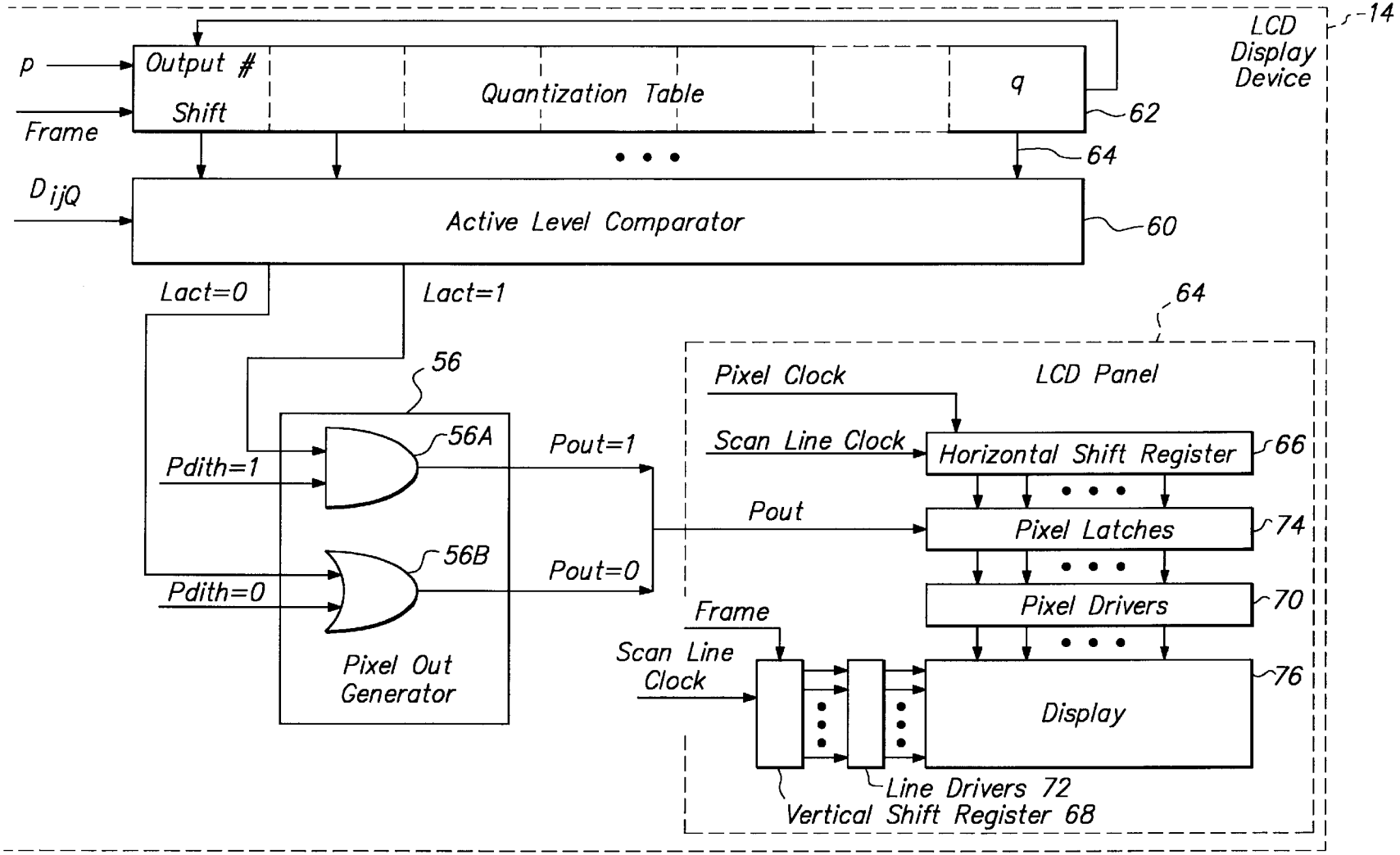
Figure 5:
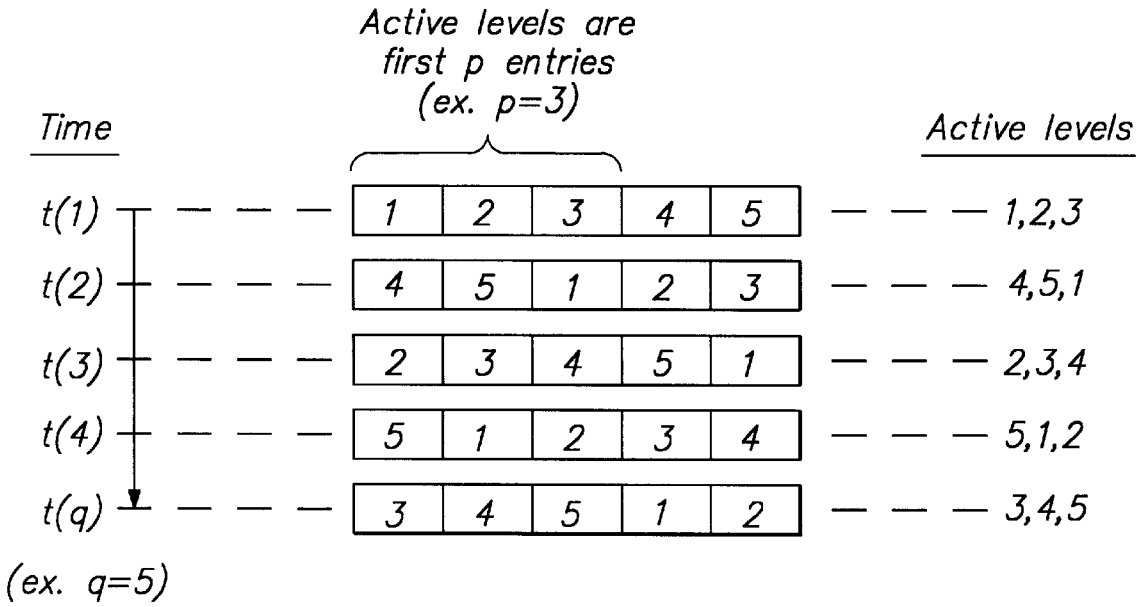
FIG. 5 is a representation of an example quantization table of the present invention with its contents shifted over five frames.

Quantization table 62 is configured as a linear, multiple-output, circular shift register as shown in FIG. 2B. The number of entries in quantization table 62 is determined by the number of frames (q) in the display period. For example, if there are 5 frames/period table 62 will be configured with 5 entries having values 1, 2, 3, 4 and 5. The number of outputs for each frame refresh will be determined by the quantized pixel value (p) being depicted. In order to generate a gray shade of p/q, linear quantization table 62 is configured with q entries having levels from 1 to q according the frames/period value q. At time t(1), the first p entries in the quantization table are selected for activation according to the quantized pixel value p on the output # line. These entries are output on output lines 64 to active level comparator 60. At each subsequent time t(2), t(3) . . . t(q), following the activation of the frame signal on the shift line, the contents of the quantization table are circularly shifted, e.g. by two positions, and the first p entries in the quantization table following the shift are selected for output on lines 64. For example, to generate a gray shade of 3/5, the quantization table as shown in FIG. 5 is generated. At each time period the first 3 entries in the table are output as active levels. As time passes, the quantization levels in these first 3 entries will change. As shown in FIG. 5, the active levels in 5 frames will be in sequence (1, 2, 3), (4, 5, 1), (2, 3, 4), (5, 1, 2), and (3, 4, 5). With this configuration, three levels will be active during any frame but the particular levels selected for activation will vary from frame to frame.

The gray shade p/q being depicted is determined by the current pixel value $P_{x,y}$ and the frame rate. As shown in FIG. 2A, the current pixel value $P_{x,y}$ is input to multi-thresholding unit 58, which will quantize the current pixel value. In the foregoing example with 5 frames/period, multi-thresholding unit 58 will quantize the current pixel value to a quantized pixel value p of 1, 2, 3, 4 or 5, with corresponding gray shades of 1/5, 2/5, 3/5, 4/5, and 5/5, respectively.

As shown in FIG. 2B, the active levels on output lines 64 of linear quantization table 62 are input to active level comparator 60. As previously discussed, the quantized dither matrix value $D_{ijQ}$ is also input to active level comparator 60. Active level comparator 60 compares each active level to the current quantized dither matrix value $D_{ijQ}$ to determine if the dither matrix value corresponding to the current pixel $P_{x,y}$ is an active or inactive level. For example, if the current pixel $P_{x,y}$ has a certain gray value and the threshold value of the dither matrix location $D_{i,j}$ that maps to that x-y coordinate is 120, then the quantized dither matrix value $D_{ijQ}$ will be 3 (compare FIGS. 3 and 4). Further, using the example shown in FIG. 5, if the display period is in the first frame t(1), active level comparator 60 will compare the current quantized dither matrix value of 3 to the current active level values of 1, 2 and 3 and find a match. Comparator 60 will then output an active level signal $L_{atv}$=1, indicating that the quantized dither matrix threshold corresponding to the current pixel matches one of the active levels in the current frame. Again using the example shown in FIG. 5, if the display period is in the second frame t(2), active level comparator 60 will compare the current quantized dither matrix value of 3 to the current active level values of 4, 5 and 1 and not find a match. Comparator 60 will then output an active level signal $L_{atv}$=0, indicating that the quantized dither matrix threshold corresponding to the current pixel does not match one of the active levels in the current frame. Two separate outputs of comparator 60 are shown for purposes of explanation but a single output $L_{atv}$ which is high (active) for $L_{atv}$=1 and low (inactive) for $L_{atv}$=0 can be implemented. The outputs of comparator 60 are input to pixel out generator 56.

Pixel out generator 56 receives the dithered pixel value $P_{dith}$ from comparator 54 and the level active value $L_{atv}$ from comparator 60. Pixel out generator is illustrated as a two gate logic operator. Logic AND gate 56A will generate a signal $P_{out}$=1 if both the dithered pixel value $P_{dith}$ and the level active value $L_{atv}$ are both equal to 1 (or high or active). This means that $P_{out}$=1 will be generated if the current pixel value exceeds the corresponding dither matrix threshold value and the quantized dither matrix value is one of the active values in the quantization table for the current frame. Logic OR gate 56B will generate a signal $P_{out}$=0 if either the dithered pixel value $P_{dith}$ or the level active value $L_{atv}$ are equal to 0 (or low or inactive). This means that $P_{out}$=0 will be generated if the current pixel value does not exceed the corresponding dither matrix threshold value or the quantized dither matrix value is not one of the active values in the quantization table for the current frame. Pixel out generator 56 is shown with two gates and two outputs for discussion purposes but can be implemented as a single AND gate having $P_{dith}$ and $L_{atv}$ inputs and a single output $P_{out}$ that is active (or 1 or high) only when the inputs are both active (or 1 or high). The $P_{out}$ signal, which represents the data value (on/off or 1/0) of the current pixel is input to LCD panel 64.

LCD panel 64 operates in a conventional manner and may include for example, horizontal and vertical shift registers 66 and 68, pixel and line drivers 70 and 72, pixel data latches 74 and an LCD display 76. Based on the pixel clock signal, the horizontal shift register 66 enables a selectable pixel latch 74 to store the incoming pixel data, which passes a captured line of pixel data through the pixel drivers 70 to form a line on display 76. Based on the scan line clock signal, vertical shift register 68 determines which line of display 76 receives the line of pixel data. With each successive scan line clock signal, vertical shift register 68 disables the previous line and uses a successive line driver 72 to enable each successive line of display 76 to receive the next line of pixel data. The process is repeated for each frame of image information.

The foregoing aspects of the present invention yield a flexible device that can be configured to depict any number of gray shades on an LCD display and is limited only by the frame rate of the particular display. The level shifted quantization table ensures transitions from frame to frame that do not result in perceived flicker or swim. The dither matrix utilized in accordance with the present invention results in dot patterns that are uniform from frame to frame.

The following is a description of the dither matrix generation operation, which is described in further detail in U.S. patent application Ser. No. 08/890,611, filed Jul. 9, 1997, which is incorporated herein in its entirety by reference.

FIGS. 6 to 11 illustrate the operation of dither matrix generator 78. Dither matrix generator 78, shown as a separate functional block for discussion purposes, may form part of processing unit 14 (FIGS. 1A, 1B and 1C) or PC 18 and may be embodied in hardware with discrete components, software, firmware, application specific integrated circuits (ASICs), or any combination thereof. Consider the case of an 8-bit-per-pixel digital image. A pixel can have any gray value between 255 (=$2^8$−1), for completely white or completely "on", and 0 for completely black or "off". When the imaging device is one like a printer, in which an increase in the applied amount of the imaging agent (ink in the case of a printer) results in a reduction in image brightness, the image data are usually converted to complementary values during the image-presentation process. The discussion that follows will be presented in terms of such complementary color values, i.e., a higher value will mean a darker image, and the application of "ink dots" rather than "on" and "off" pixels but the principles apply equally to a positive-color or gray shade presentation such as that which occurs in an LCD display or cathode-ray tube.

To make the description more concrete, we will assume that the matrix is intended for a dither operation having eight-bit input values and one-bit output values, so there are 256 possible input pixel values for each pixel. The number of different threshold values must therefore be one less, i.e., 255. Assuming a matrix size of 128×128, each threshold value will be present at either 64 or 65 dither-matrix locations (191 values×64 locations/value+65values×64 locations/value=128×128 locations).

Now, the general approach for assigning dither-matrix values starts with somewhat arbitrarily choosing an initial light-gray value and selecting the (sparse) initial dot pattern that should be used in a subregion that is to present that initial gray level uniformly. Various approaches to obtaining that initial dot pattern can be used. The dot pattern can be obtained, for instance, from a dither-matrix-sized subregion of the output produced by applying "error diffusion" to an image consisting uniformly of the initial gray level. Error diffusion is a well-known half-toning method in which the quantization error that results from half-toning at one pixel is "diffused" to neighboring pixels. Error diffusion tends to minimize overall error better than dithering, but dithering is preferred in many situations because it is less computation intensive.

Figure 6:
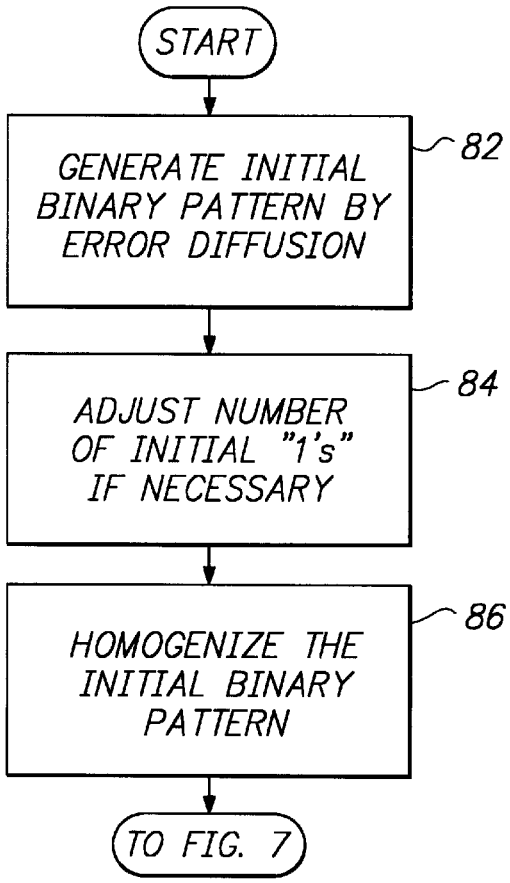
FIG. 6 is a flow chart of the initialization stage of the present invention's method of generating a dither matrix.

FIG. 6's block 82 represents the error-diffusion process. The purpose of the sequence that FIG. 6 represents is to generate a binary-value matrix whose size is that of the dither matrix to be generated and whose elements indicate whether the corresponding subregion pixels will receive an ink dot when that subregion presents a uniform gray value equal to the starting value: binary-value-matrix locations containing "1's" correspond to the subregion pixels that should receive ink dots when all input pixel values equal the starting value, and binary-value-matrix locations containing "0's" correspond to the other subregion pixels. Suppose the initial gray-scale value is, say, 10 (light gray) on a scale of 0 (white) to 255 (black). That means that ink should ideally be deposited at 642 subregion pixels, i.e., at 10/255 of the 128×128 subregion pixels, so there should ideally be that many logical "1's" in the error-diffusion output.

In practice, the number of "1's" may not be quite 642, so points may have to be added, as block 84 indicates. The matrix locations chosen for dot addition are selected from among candidates corresponding to pixels that contain "Voronoi vertices." As will be explained below in connection with FIG. 8, a Voronoi vertex is a point that is equidistant from the centers of at least the three dot-containing pixels to which it is closest, and the largest void, or white space, will therefore contain such a point. Just which of these points is disposed in the largest void is determined by assigning each candidate location a score that results from centering a convolution kernel on the candidate and taking the sum of the kernel coefficients that thereby correspond to pixels that do not yet contain dots. An 11×11 Gaussian kernel having a standard deviation of 1.5 pixel widths is an appropriate kernel for this purpose, although other kernel types can be used instead. We describe various other metrics for void size and cluster tightness in connection with subsequent phases of the method.

Even if the number of dots needs no adjustment, the error-diffusion process may leave inhomogeneities in those dots' placement, and a homogenization process 86 is performed by moving "1's" from the tightest clusters to the largest voids until removal of a "1" from the tightest cluster creates the largest void.

Having now identified the subregion pixels that should receive ink dots to produce the initial gray-scale level, we turn to the task of assigning the dither-matrix thresholds that will result in ink dots so located. We assign the thresholds in phases. We know that the thresholds in the dither-matrix locations corresponding to the "1"-containing initial binary-value matrix should all be less than 10, and the thresholds should be 10 or more at all other locations. The first phase of the threshold-assigning task is to determine the locations of all thresholds less than 10.

Figure 7:
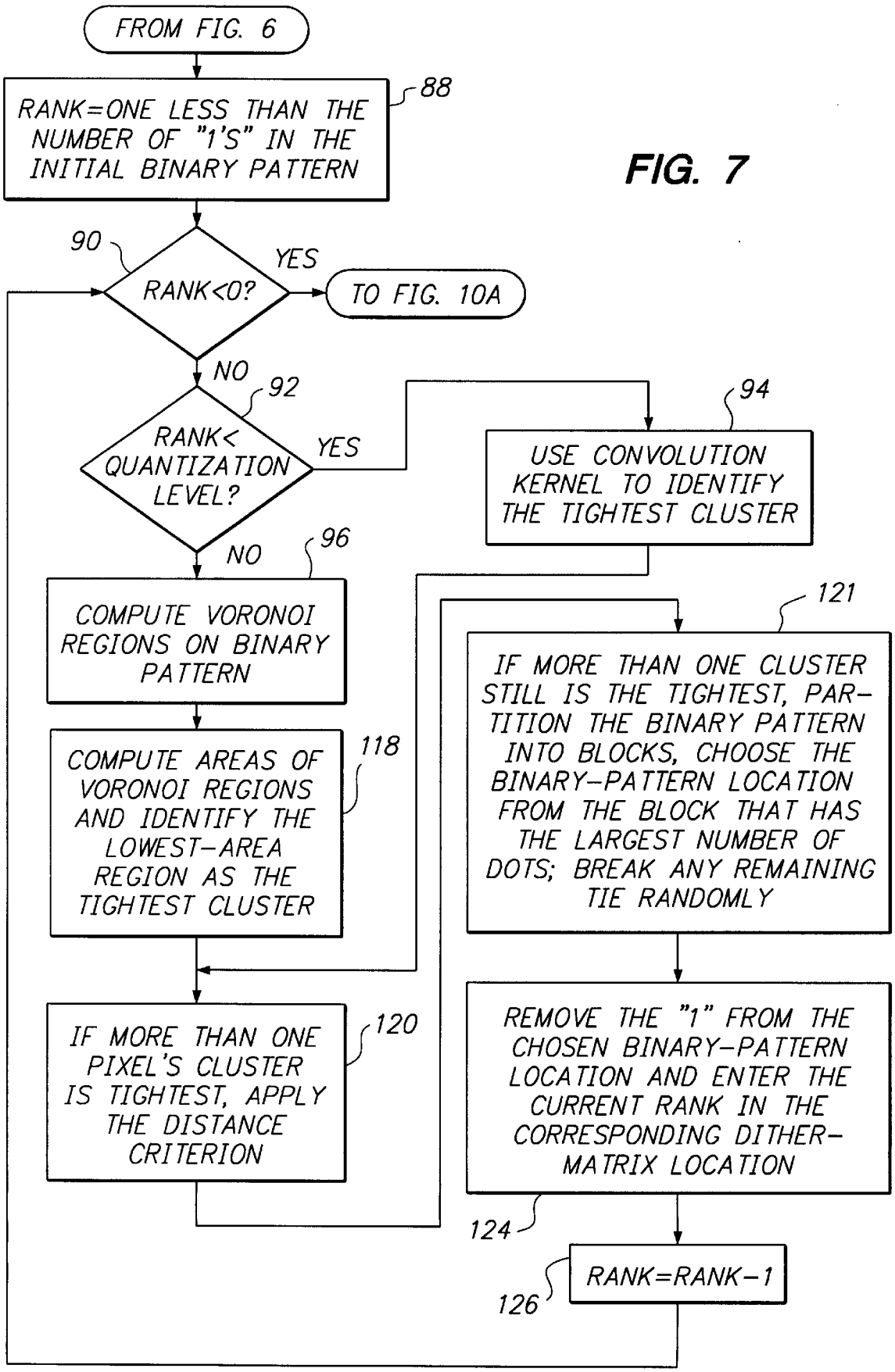
FIG. 7 is a flow chart of the present invention's method of assigning the lowest rank values to the dither-matrix locations.

FIG. 7 depicts this phase, which involves repetitively removing a "1" from the binary matrix's most-crowded location, i.e., conceptually removing an ink dot from the remaining ink-dot location that is most crowded after previous ink-dot removals. When enough "1's" have been removed to reduce the number remaining to the number of ink dots needed to present an gray value of 9, all dither-matrix locations corresponding to binary-value-matrix locations from which "1's" have been removed in the process should receive a threshold value of 9: ink-dot deposition should be permitted at those locations when the gray level is 10 but not when it is 9. By continuing to remove "1's" in this fashion, locations that should receive the threshold values from 8 through 0 can be similarly identified.

FIG. 7 depicts this phase of the operation without referring to actual threshold values, which depend on the number of quantization levels and dither-matrix size (in the example, $2^8$=256 and 128×128, respectively). FIG. 7 instead describes it in more-general terms as assigning each location a rank, which indicates the corresponding subregion pixel's order in the sequence in which those pixels would receive ink dots if the subregion were being darkened as incrementally as the number of subregion pixels allows. That is, the rank and threshold are the same if the number of input quantization levels ($2^8$ in this example) is one greater than the number of dither-matrix locations (128×128 in this example), which therefore equals the number of thresholds. Otherwise, the threshold is readily obtained from the rank by using a relationship such as:

$$T=\mathrm{trunc}(RN_T/N_L),$$

where T is the threshold value, trunc(x) is the highest integer not greater than x, R is the rank, $N_T$ is the number of thresholds ($2^8-1$=255 in the example), and $N_L$ the number of dither-matrix locations. We prefer to assign by computing rank values initially, since explicitly assigning and storing rank values permits the same assignment operation to be used for different degrees of quantization. That is, once ranks R have been determined, different dither matrices can be generated for different values of $N_T/N_L$ without any further processing other than applying the above equation for T. As the foregoing equation indicates, though, assigning a dither-matrix location a rank is equivalent to assigning it a threshold for the purposes of the present invention, and we will refer to the two concepts interchangeably.

The rank of the dither-matrix location corresponding to the first binary-matrix location from which a "1" is discarded in the example would be 641, since it would be the last of the first 642 locations to receive an ink dot if the subregion were being darkened incrementally. FIG. 7's block 88 represents thus initializing the rank value. The procedure that FIG. 7 represents is repeated for increasingly low rank values until all of the ranks for the initially chosen locations have been assigned as determined in a step that block 90 represents.

We use two different ways of identifying the location corresponding to the most-crowded subregion pixel. When the population of "1's" in the binary-value matrix—that is, the number of ink dots remaining in the subregion that the dither matrix conceptually covers-reaches the number of locations that should receive a threshold value of 0, as determined in a step that block 92 indicates, we assess the degree of crowding by centering a convolution kernel on the candidate and taking the sum of the kernel coefficients that thereby correspond to pixels in which dots remain. As before, we use an 11×11 kernel whose values are proportional to a two-dimensional Gaussian function having a standard deviation of 1.5. Block 94 represents selecting among locations on the basis of crowding as thereby assessed.

Before the number of remaining dots falls to the 0-threshold level, however, the most-crowded pixels are identified by Voronoi partitioning, which block 96 represents. Voronoi partitioning can be understood by reference to FIG. 8.

Figure 8:
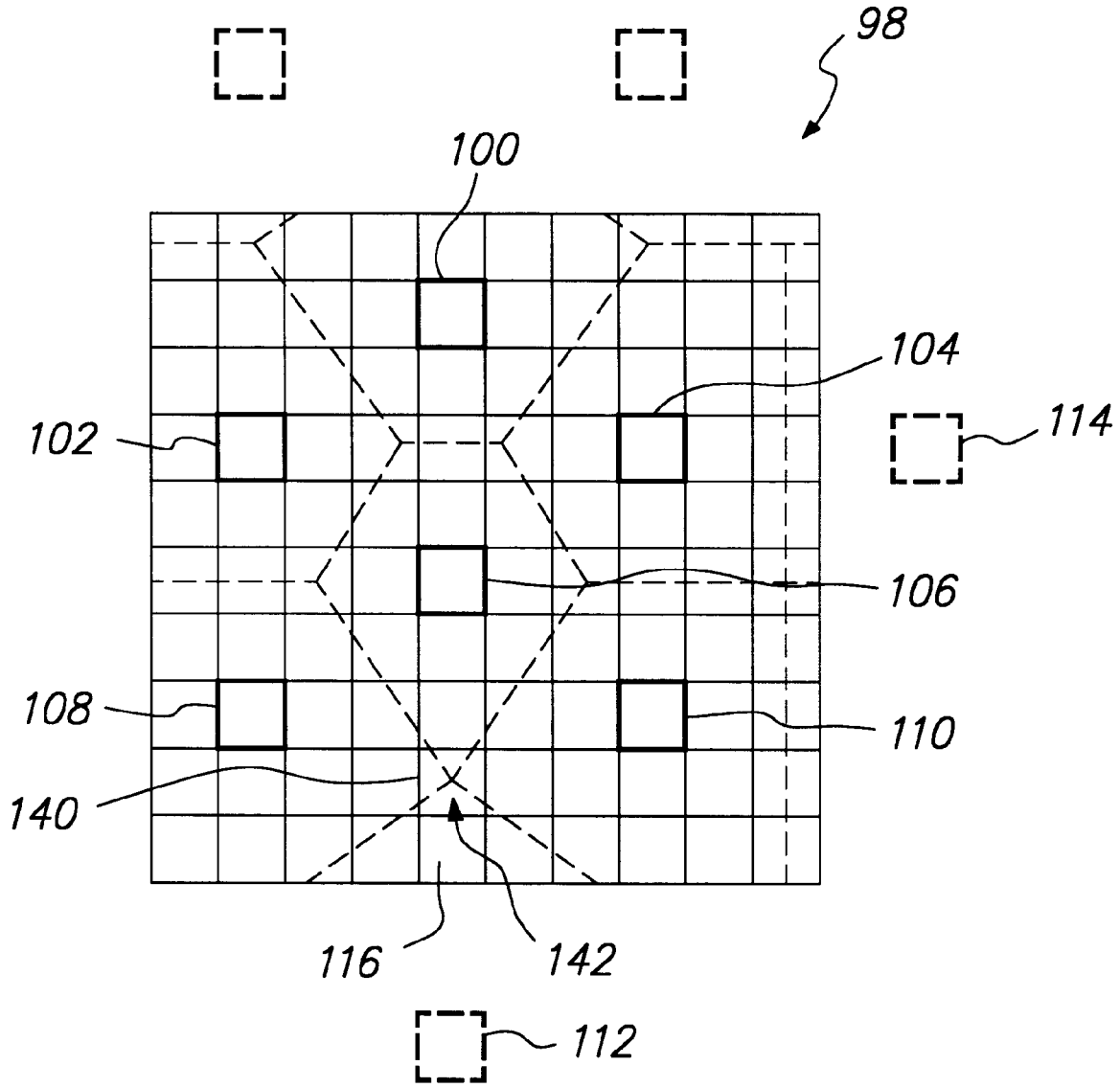
FIG. 8 is a diagram used to illustrate Voronoi partitioning.
Figure 9A:
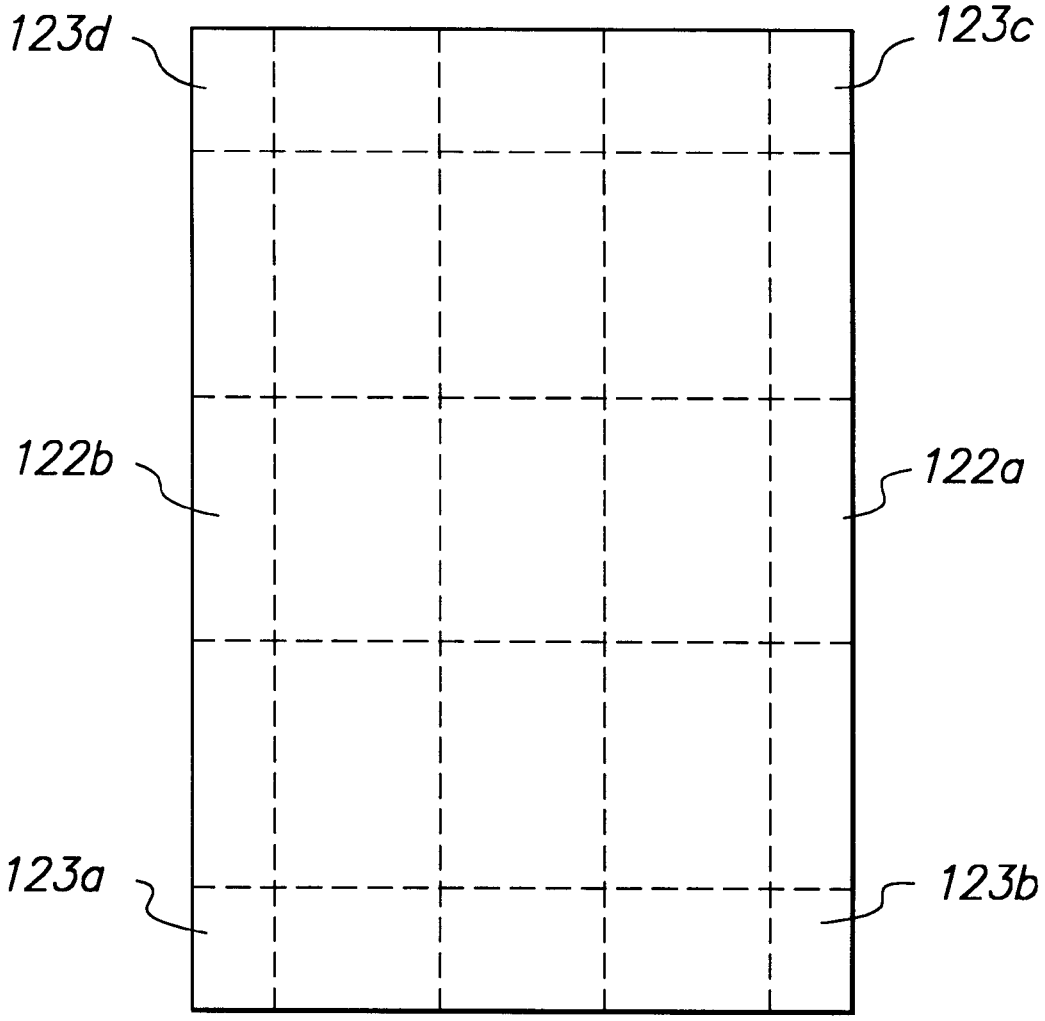
FIGS. 9A–C illustrate block partitioning.
Figure 9B:
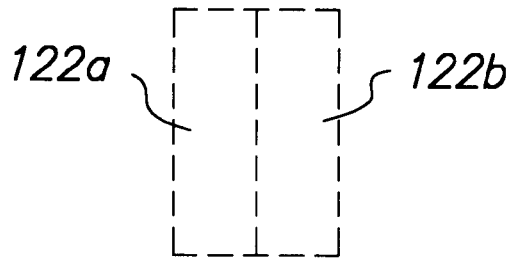
Figure 9C:
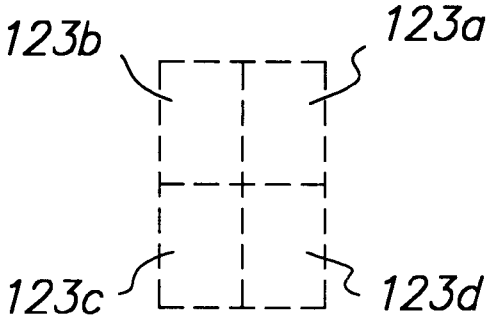

FIG. 8 depicts a subregion 98 defined by a dither matrix whose size is 10×10 for the sake of illustration; i.e., it is much smaller than the 128×128 example dither matrix referred to above. Let us assume that the binary matrix, which specifies which pixels will receive ink dots when the subregion 98 is to present one of the light-gray levels to which the FIG. 7 routine is directed, specifies that only pixels 100, 102, 104, 106, 108, and 110 are to receive ink dots. To each of the pixels thus selected, Voronoi partitioning associates a partition consisting of all points that are at least as close to that pixel's center as to the center of any other pixels still selected to receive ink dots. Procedures for determining the (polygonal) partitions' vertices and ordering those vertices for area-determination calculations are well known in the art and can be found, for instance, in K. Mulmuley, *Computational Geometry, An Introduction Through Randomized Algorithms*, Prentice-Hall, Englewood Cliffs, N.J., 1994.

In performing the partitioning, it must be remembered that the dither matrix is to "tile" the image; in a uniform gray image adjacent subregions' pixels 112 and 114 receive ink dots whenever corresponding pixels 100 and 102 do, so the resultant partitioning is as FIG. 8's dashed lines indicate. In particular, pixel 100's partition includes area 116, too, because the points that area 116 contains are closer to the corresponding pixel 112 than to pixels 108 and 110. One way of looking at this is to consider the subregion a flexible sheet, form a tube from the sheet by attaching its top edge to its bottom edge, connect the two ends tube form a torus, and use the geodesic distances between points on the resultant torus to determine the Voronoi partitions.

The partitions are used to determine which ink-dot-receiving pixel is in the area most crowded by ink dots. The pixel associated with the lowest-area Voronoi partition is considered to be associated with the tightest cluster.

If only one such pixel's cluster is tightest, the corresponding dither-matrix location is the one to which the current rank is assigned. If more than one pixel's partition has the lowest area, one might simply select among the lowest-partition-area pixels at random to select the next pixel whose ink dot will be removed. But we have found that applying a further criterion for pixel selection tends to suppress visually disturbing artifacts that would otherwise remain.

Whereas the cluster-tightness measure applied in FIG. 7's step 118 indicates how crowded by other ink-dot-containing pixels the candidate pixel corresponding to the candidate dither-matrix location is, the cluster-tightness measure applied in block 120 indicates how crowded the candidate location is by locations whose ranks (as so far determined) are close to the rank being assigned. What constitutes "close" is a matter of design choice. For example, some designs may consider a rank close if its associated threshold is the same or differs by only one from the threshold value being assigned. Others may consider a rank close if it differs from the rank being assigned by less than the number of subregion pixels per threshold value (=64 or 65 in the example). We call this the "distance criterion."

The present invention's teachings can be implemented by employing a Voronoi-partitioning cluster-tightness measure to apply this criterion, but we prefer a different measure. In the step that block 120 represents, the measure of the tightness with which such closely ranked pixels are clustered about a given pixel is simply the lowest distance from the given pixel to a closely ranked pixel: of candidate locations that tied in step 118, the one considered to be in the tightest cluster of such closely ranked locations is the candidate whose distance to the closest closely ranked location is lowest. That is, if $P=\{p_i;\ i=0, \ldots, M-1\}$ is the set of M such closely ranked locations and $X=\{x_j;\ j=0, \ldots, N-1\}$ is the set of N candidate locations that survive step 118, then the index J of the location to be ranked next is given by:

$$J = \arg\min_j \left\{ \min_i \ D(x_j, p_i) \right\},$$

where D(x,y) is the minimum geodesic distance on the torus described above between the subregion pixels that correspond to locations x and y.

If this criterion, too, results in a tie, we apply yet another criterion to the tied locations, as block 121 indicates. For this criterion, the entire subregion matrix is divided into blocks. For example, if the binary-value-matrix size is 128×128, we may divide the subregion of FIG. 9A into sixteen blocks of size 32×32, as that drawing's dashed lines indicate. For reasons similar to those discussed above by reference to FIG. 8, a block's locations correspond to pixels that are close when the planar subregion is deformed into a torus, so a location corresponding to a pixel near one edge of the subregion belongs to the same block as a location corresponding to a pixel near the opposite edge. For instance, FIG. 9A's sub-blocks 122*a–b* form the single block of FIG. 9B, and FIG. 9A's sub-blocks 123*a–d* form the single block of FIG. 9C.

If a block in which the pixel corresponding to a given one of the surviving candidates is located contains more remaining dots than the blocks that contain pixels corresponding to any of the other surviving candidates—i.e., if the corresponding submatrix of the binary-value matrix contains more remaining "1'" than the does any other submatrix corresponding to a block that contains a surviving candidate—then the given surviving candidate is the one selected to be ranked next. Otherwise, the choice among the surviving candidates is made on a random basis.

The next location having thus been selected, the current rank (or, equivalently, the associated threshold value) is entered into the corresponding location in the dither array, as block 124 indicates, and the rank to be assigned in the next loop is decremented, as block 126 indicates. The loop of FIG. 7 is then repeated until the rank value of 0 has been assigned.

Figure 10A:
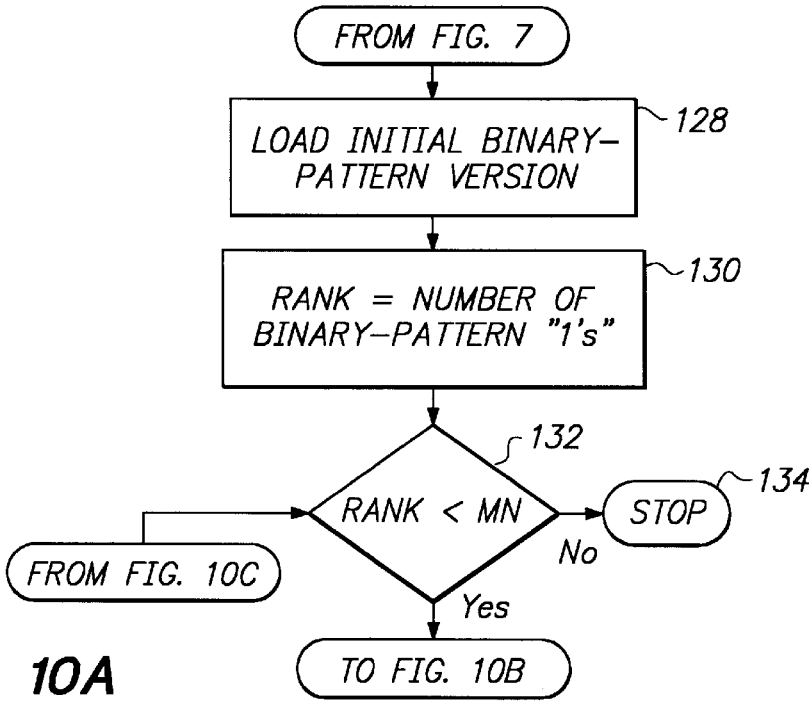
FIGS. 10A–C together form a flow chart of the present invention's method of assigning the higher rank values to the dither-matrix locations.
Figure 10C:
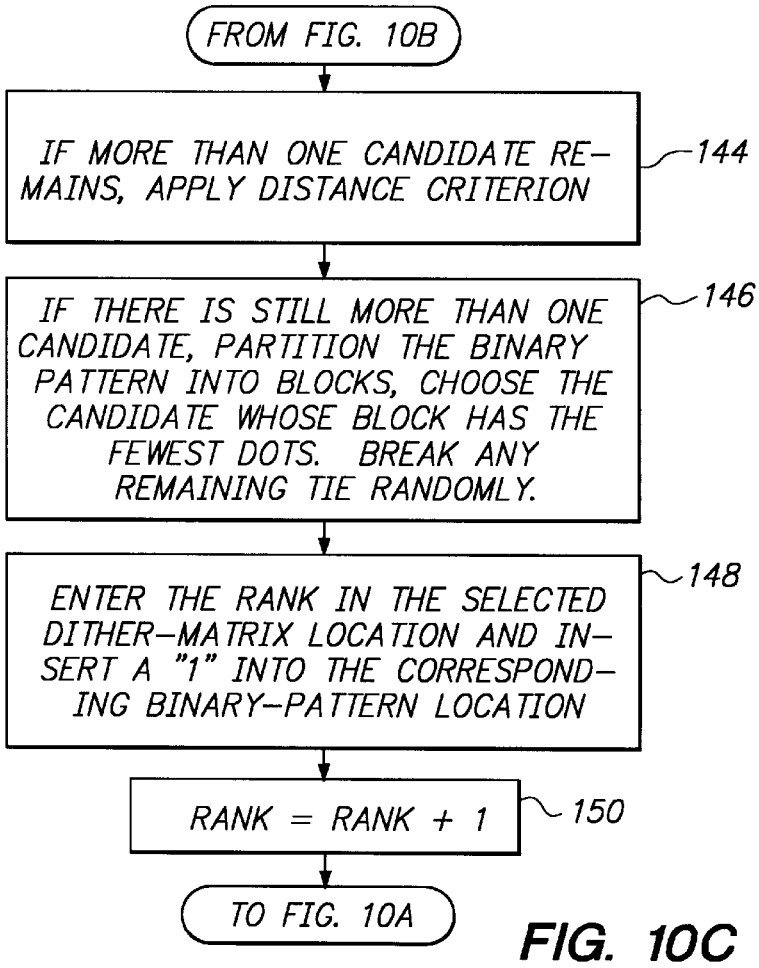
Figure 10B:
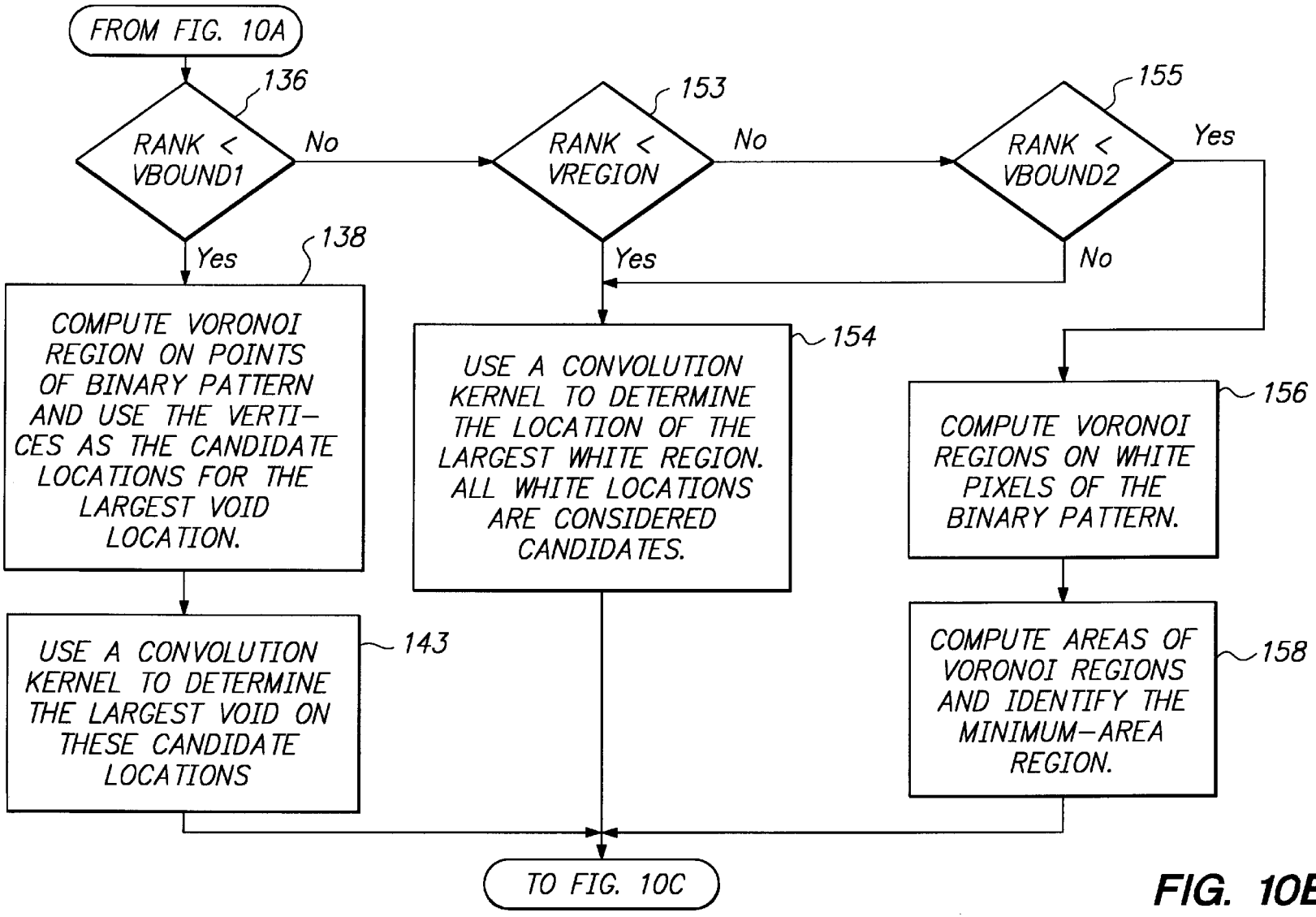

In contrast to the FIG. 7 routine, which assigns ranks in descending order to locations that will receive thresholds lower than the initially chosen gray-scale value, the routine of FIGS. 10A, 10B, and 10C (collectively, "FIG. 10") assigns ranks in ascending order to locations that will receive thresholds higher than that. As block 128 indicates, the FIG. 10 routine begins with the same initial binary-value matrix that the FIG. 7 routine did, but the FIG. 10 routine assigns ranks to locations corresponding to the "0's" in the initial binary-value matrix, not to the locations that correspond to its "1's."

As block 130 indicates, this routine begins with a rank equal to the number of "1's" in the initial binary-value matrix; i.e., it begins with the lowest rank still unassigned. As blocks 132 and 134 indicate, the routine stops when the incremented rank value is no longer less than the total number of dither-matrix locations, which is MN in an M×N matrix.

Until then, the next rank's location is selected in a manner that depends on that rank's value. FIG. 10B shows that the rank range is divided into four intervals. The lowest interval's upper bound $V_{BOUND1}$ in the example is 1600, or about 10% of the total rank range. Now, when ranks in this range are being assigned, the overwhelming majority of the binary-value matrix's locations contain "0's": nearly all locations are yet to be assigned thresholds. In the subregion 98 that FIG. 8 depicts, for instance, all of the pixels except pixels 100, 102, 104, 106, 108, and 110 are candidates. So, as FIG. 10B's blocks 136 and 138 indicate, the routine reduces the number of candidate locations by performing Voronoi partitioning. Specifically, a location is considered a candidate only if it corresponds to a subregion pixel, such as pixel 140, that contains a resultant partition vertex such as vertex 142.

The method determines which of these locations corresponds to a (Voronoi-vertex-containing) subregion pixel in the largest void, or white space, by assigning each candidate location a score that results from centering a convolution kernel on the candidate and taking the sum of the kernel coefficients that thereby correspond to pixels that do not yet contain dots. Block 143 represents this step, which can also be thought of as identifying the pixel about which dot-receiving pixels are clustered least tightly. One type of kernel that can be used for this purpose is a 9×9 1.5-pixel-width-standard-deviation Gaussian kernel, of which FIG. 11 depicts an example.

If a tie score results, we apply the distance criterion, as block 144 indicates. The operation is the same as that of FIG. 7's step 120, with two exceptions. First, the ranks of already-assigned locations in the set used in applying the criterion are lower than the rank being assigned, not higher. Second, since dots are conceptually being added to the largest voids rather than removed from the tightest clusters, the pixel selected is the one about which such closely ranked pixels are clustered most loosely, not most tightly, so the search is for the maximum distance, not the minimum. That is, if $P=\{p_i;\ i=0, \ldots, M-1\}$ is the set of M such closely ranked locations and $X=\{x_j;\ j=0, \ldots, N-1\}$ is the set of N candidate locations that survive the previous step, then the index J of the location to be ranked next is given by:

$$J = \arg\max_j \left\{ \min_i \ D(x_j, p_i) \right\},$$

where D(x,y) is the minimum geodesic distance on the torus described above between the subregion pixels that correspond to locations x and y.

If a tie still results, we break it, as block 146 indicates, by employing a criterion complementary to the block-partitioning criterion used in FIG. 7's block 121. If a block in which the pixel corresponding to a given one of the surviving candidates is located contains fewer dots than the blocks that contain pixels corresponding to any of the other surviving candidates—i.e., if the corresponding submatrix of the binary-value matrix contains fewer "1's" than the does any other submatrix corresponding to a block that contains a surviving candidate—then the given surviving candidate is the one selected to be ranked next. Any further tie is broken by random selection.

The order in which initially tied candidates are ranked, which we determine by applying the criteria of steps 144 and 146—or those of FIG. 7's steps 120 and 121—is important in several situations. First, if the number of tied candidates exceeds the number of locations to which the current threshold still needs to be assigned—e.g., if the number of such candidates is greater than 64 or 65 for an 128×128 array of 255 different threshold values—then the rank order affects the thresholds that different ones of those tied locations will receive, so disturbing light- and mid-tone artifacts will tend to occur if the selection is made imprudently. Second, if the selected candidate is located within the area to which a selection criterion's convolution kernel is applied to compute another candidate's score, that score will change and can prevent what might otherwise have been that other location's selection to receive the same threshold. Third, another candidate's score can similarly be changed, with similar results, if its Voronoi partition shares one or more vertices with the selected candidate's and thus has the size of its Voronoi partition changed by that selection. In practicing the present invention, one could test for these conditions and use the additional selection criteria only if they apply, but we prefer to use the additional criteria uniformly so that the resultant dither matrix's quality is relatively independent of the number of quantization levels and thus of the number of locations that are to be assigned any given threshold.

We enter the rank (or threshold) in the selected dither-matrix location and, since the FIG. 10 routine assigns ranks in ascending order, i.e., in the direction of increased image darkness, we then add a "1" to the corresponding binary-value-matrix location, as block 148 indicates. Block 150 represents incrementing the rank before repeating the FIG. 10 loop.

At some point, the number of "1's" in the binary-value matrix—i.e., the number of ink dots that will cause it to achieve the gray value that corresponds to the rank currently being assigned—is large enough that computing Voronoi partitions based on the already-assigned locations becomes less attractive. This is the level we refer to above as $V_{BOUND1}$. If the rank to be assigned exceeds that level but is lower than a level $V_{REGION}$, at which the number of "0's" has been reduced to the number of "1's" to which level $V_{BOUND1}$ corresponds, then the number of candidate white spaces is not reduced by Voronoi partitioning, as it was in step 138. Instead, all white spaces are assigned scores by applying a kernel in the manner described above in connection with step 143. Blocks 153 and 154 represent this aspect of the FIG. 10 routine. If necessary, the number of candidate locations is further reduced, as before, in FIG. 10C's steps 144, 146, and 148.

Once the rank to be assigned has reached level $V_{REGION}$, which equals 90% of the total rank range, the number of "0's" has been reduced to the number of "1's" to which level $V_{BOUND1}$, corresponds, so it again becomes attractive to use Voronoi partitioning—if the partitions are based on the locations of the binary matrix's "0's" rather than on the location of its "1's." As blocks 155, 156, and 158 indicate, this is accordingly what the FIG. 10 routine does so long as the rank to be assigned is less than a higher level, $V_{BOUND2}$, at which the number of remaining "0's," i.e., the number of locations left to be assigned ranks, equals the number of dither-matrix locations per threshold (64 or 65 in the example). This number is low enough that no special effort needs to be taken to reduce the number of candidate locations. When the rank to be assigned does exceed $V_{BOUND2}$, then the routine uses the block-154 operation to assign scores. In either case, the operations of FIG. 10C are again employed if necessary to eliminate ties.

The process of FIGS. 7 and 10 can be used to assign thresholds explicitly as locations are chosen or instead merely to assign ranks and thereby produce as its output a dither matrix of ranks, which implicitly indicate the thresholds. In the latter case, thresholds are thereafter assigned explicitly in accordance with the relationship outlined above. The resultant matrix is then stored in dither matrix 48 and is utilized in the present invention as described hereinabove.

Figure 12:
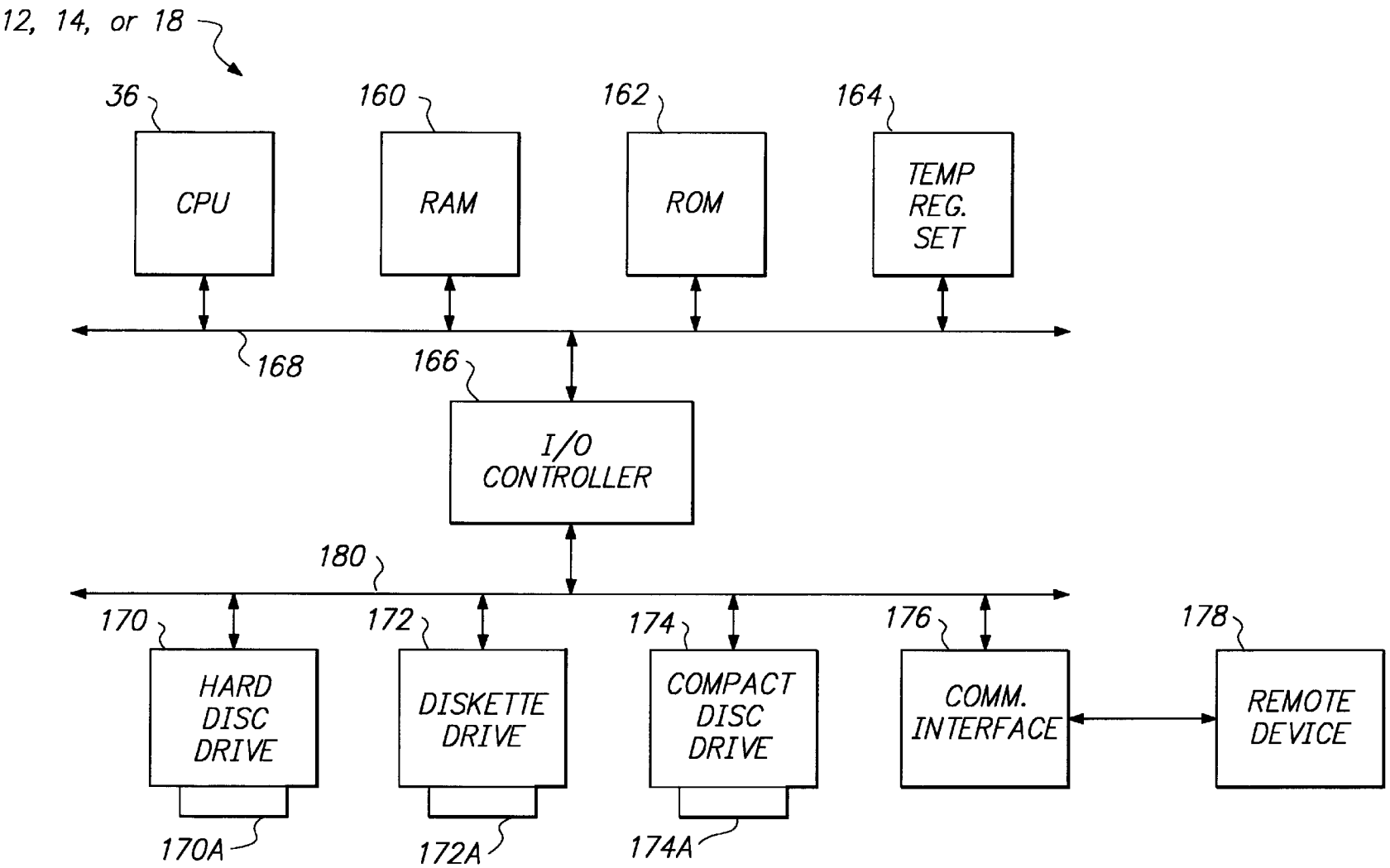
FIG. 12 is a schematic block diagram of another portion of the major functional components of the present invention.

While in the foregoing description various functional units have been represented as forming part of the LCD display device 14, they may also form part of image processing unit 12 or form part of other system components such as personal computer 18. As shown in FIG. 12, LCD display device 14, image processing unit 12 and/or PC 18 may further include, for example, a central processing unit (CPU) 36, memories including a random-access-memory (RAM) 160, read-only memory (ROM) 162 and temporary register set 164, and an input/output controller 166, all connected to an internal bus 168. Although for the sake of illustration each of the above units are shown separately, these functional units may form part or all of the various functional units previously described such as video memory 42, dither matrix 48, dither matrix generator 78, multi-thresholding unit 58, comparator 60, etc. Further, depending on the nature of the system, e.g. a scanner, printer and LCD display as part of a centrally controlled network, the functional units may be part of a general purpose computer programmed to control the scanning, printing and LCD display devices. Additionally, it will be appreciated that these functional units may be implemented with discrete components, application specific integrated circuits, processors executing appropriate software and the like or any combination thereof.

Operating system software and/or application specific software for operating LCD device 14 and/or the image processing unit 12 and/or the various functional units described herein may be stored in any combination of the memories 160, 162 and 164 or may be stored externally in one or more of the I/O units including hard disc drive unit 170, diskette drive unit 172, and compact disc drive 174, each connected to I/O Bus 180. Software for operating the various functional units and/or for implementing the method of the present invention may be stored on a medium such as hard disc 170A, diskette 172A or compact disc 174A, or may be stored at a remote device 178 and input through communications interface 176.

Figure 13:
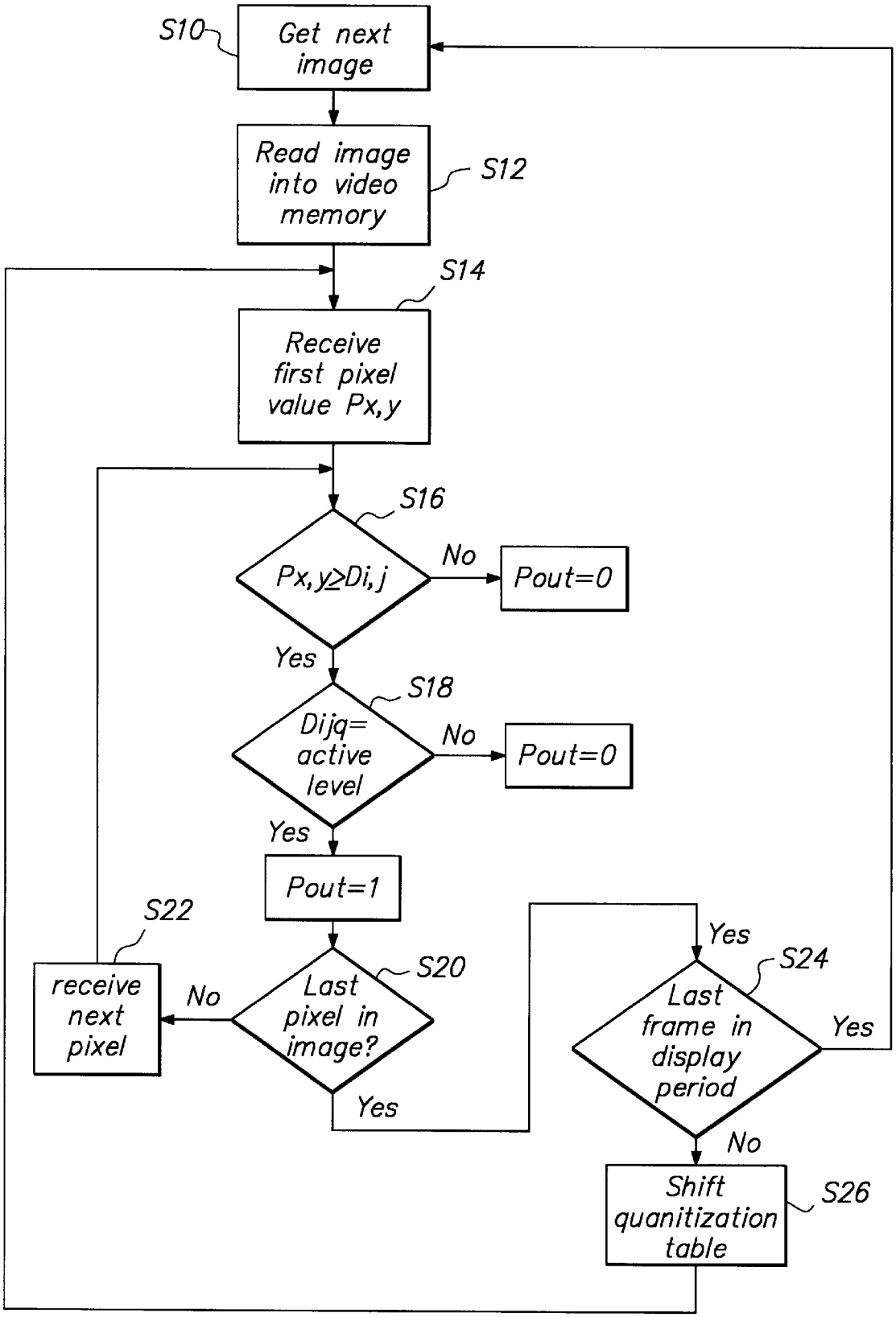
FIG. 13 is a flowchart showing the general steps of the method of the present invention.

FIG. 13 shows the general flow of the method of the present invention. At step S10, as an example, the graphics controller 38 will retrieve the next image and cause it to be read into the video memory 42 at step S12. The retrieval and temporary storage of image data will vary from device to device and will depend on the relative speed of devices, storage capacity and bandwidth. Such operations are well known in the art. At step S14, the first pixel $P_{x,y}$ value, which represents a gray shade or color, is received. At step S16, this pixel value is compared with a corresponding dither matrix threshold $D_{i,j}$. If the pixel value is less than the threshold, the output pixel value $P_{out}$ sent to the LCD display will be 0 (or off). If the current pixel value is at least as great as the threshold value then the quantized dither matrix threshold $D_{ijQ}$ is compared at step S18 to the active levels of the quantization table. If the quantized dither matrix threshold $D_{ijQ}$ is one of the active levels of the quantization table, then the output pixel value $P_{out}$ sent to the LCD display will be 1 (or on). At step S20 if the current pixel is not the last pixel in the image, the next pixel is received at step S22 and the loop starting at S16 is repeated until the complete image is displayed for the current refresh frame cycle, and the process moves to step S24. If this is the last frame refresh in the display cycle, the next image is retrieved at step S10. If not, the levels in the quantization table are shifted so that new levels are now active and the process loops back to step S14 to receive the first pixel of the current image.

While the invention has been described in conjunction with several specific embodiments, it is evident to those skilled in the art that many further alternatives, modifications and variations will be apparent in light of the foregoing description. Thus, the invention described herein is intended to embrace all such alternatives, modifications, applications and variations as may fall within the spirit and scope of the appended claims.

What is claimed is:

1. An apparatus for enhancing the gray shade rendering capability of a display device, said display device having a frame rate of q frames per display cycle, comprising:

a first comparator for comparing an intensity value representing a gray shade of a current pixel with a respective dither matrix threshold value and for providing a pixel on/off signal;

a quantization table for storing a plurality of quantization values ranging from 1 to q and for outputting p quantization values as active quantization values in accordance with a quantized pixel value p and for shifting said quantization values in said table in response to a frame signal;

a second comparator for comparing a quantized dither matrix threshold value to said active quantization values to produce an active quantized threshold signal;

a pixel out generator responsive to said pixel on/off signal and said active quantized threshold signal for producing a pixel out signal;

a display responsive to said pixel out signal for displaying said current pixel with an average gray value of p/q through a display period of q frames.

2. An apparatus as in claim 1 further comprising a dither matrix for storing a plurality of threshold values.

3. An apparatus as in claim 2 further comprising at least one counter responsive to coordinates of a current pixel for addressing said dither matrix to output said respective dither matrix threshold value.

4. An apparatus as in claim 2 further comprising a multi-thresholding unit for quantizing said respective dither matrix threshold value to produce a quantized dither matrix threshold value ranging from 1 to q.

5. An apparatus as in claim 2 further comprising a dither matrix generator for generating said dither matrix, comprising:

means for generating a dither matrix of dither-matrix locations that contain dither-matrix thresholds and are associated with respective subregion pixels of an image subregion by repeatedly assigning thresholds to the dither-matrix locations;

means for determining for each of a plurality of the subregion pixels the relative tightness thereto with which are clustered thereabout pixels that receive dots when the subregion presents a uniform gray-scale level that corresponds to the threshold being assigned;

means for identifying each subregion pixel for which the tightness thereby determined is greatest;

means for determining for each of a plurality of the subregion pixels thus identified the relative tightness thereto with which are clustered thereabout subregion pixels that have been assigned thresholds whose ranks is in a rank range that depends on the threshold being assigned and excludes some subregion pixels that receive dots when the subregion presents the uniform gray-scale level that corresponds to the threshold being assigned;

means for selecting at least one subregion pixel for which the tightness thereby determined is greatest; and means for assigning the threshold to a dither-matrix location associated with a subregion pixel thus selected.

6. An apparatus as in claim 1 further comprising a multi-thresholding unit for quantizing said intensity value representing a gray shade of said current pixel to produce said quantized pixel value p ranging from 1 to q.

7. An apparatus as in claim 1 wherein said quantization table comprises a shift register.

8. An apparatus as in claim 7 wherein said quantization table comprises a circular shift register.

9. An apparatus as in claim 7 wherein said quantization table comprises a circular, linear shift register.

10. An apparatus as in claim 1 wherein said display is a liquid crystal display (LCD).

11. A method for enhancing the gray shade rendering capability of a display device, said display device having a frame rate of q frames per display cycle, comprising:

comparing an intensity value representing a gray shade of a current pixel with a respective dither matrix threshold value and providing a pixel on/off signal;

storing a plurality of quantization values ranging from 1 to q in a quantization table;

outputting p quantization values from said quantization table as active quantization values in accordance with a quantized pixel value p;

shifting said quantization values in said table in response to a frame signal;

comparing a quantized dither matrix threshold value to said active quantization values and producing an active quantized threshold signal;

producing a pixel out signal in response to said pixel on/off signal and said active quantized threshold signal;

in response to said pixel out signal displaying said current pixel with an average gray value of p/q through a display period of q frames.

12. A method as in claim 11 further comprising storing a plurality of threshold values in a dither matrix.

13. A method as in claim 12 further comprising addressing said dither matrix in response to coordinates of a current pixel and outputting said respective dither matrix threshold value.

14. A method as in claim 12 further comprising quantizing said respective dither matrix threshold value to produce a quantized dither matrix threshold value ranging from 1 to q.

15. A method as in claim 12 further comprising generating said dither matrix, said dither matrix generating step comprising:

generating a dither matrix of dither-matrix locations that contain dither-matrix thresholds and are associated with respective subregion pixels of an image subregion by repeatedly assigning thresholds to the dither-matrix locations;

determining for each of a plurality of the subregion pixels the relative tightness thereto with which are clustered thereabout pixels that receive dots when the subregion presents a uniform gray-scale level that corresponds to the threshold being assigned;

identifying each subregion pixel for which the tightness thereby determined is greatest;

determining for each of a plurality of the subregion pixels thus identified the relative tightness thereto with which are clustered thereabout subregion pixels that have been assigned thresholds whose ranks is in a rank range that depends on the threshold being assigned and excludes some subregion pixels that receive dots when the subregion presents the uniform gray-scale level that corresponds to the threshold being assigned;

selecting at least one subregion pixel for which the tightness thereby determined is greatest; and assigning the threshold to a dither-matrix location associated with a subregion pixel thus selected.

16. A method as in claim 11 further comprising quantizing said intensity value representing a gray shade of said current pixel to produce said quantized pixel value p ranging from 1 to q.

17. A method as in claim 11 further comprising storing said quantization table in a shift register.

18. A method as in claim 17 further comprising shifting said quantiztion values in said quantization table circularly.

19. A method as in claim 17 further comprising storing said quantization values linearly in said quantization table.

20. A method as in claim 11 further comprising displaying said current pixel on a liquid crystal display (LCD).

21. A medium readable by a machine embodying a program of instructions executable by said machine to perform a method of enhancing the gray shade rendering capability of a display device, said display device having a frame rate of q frames per display cycle, said enhancing method comprising:

comparing an intensity value representing a gray shade of a current pixel with a respective dither matrix threshold value and providing a pixel on/off signal;

storing a plurality of quantization values ranging from 1 to q in a quantization table;

outputting p quantization values from said quantization table as active quantization values in accordance with a quantized pixel value p;

shifting said quantization values in said table in response to a frame signal;

comparing a quantized dither matrix threshold value to said active quantization values and producing an active quantized threshold signal;

producing a pixel out signal in response to said pixel on/off signal and said active quantized threshold signal;

in response to said pixel out signal displaying said current pixel with an average gray value of p/q through a display period of q frames.

22. A medium as in claim 21 wherein said enhancing method further comprises storing a plurality of threshold values in a dither matrix.

23. A medium as in claim 22 wherein said enhancing method further comprises addressing said dither matrix in response to coordinates of a current pixel and outputting said respective dither matrix threshold value.

24. A medium as in claim 22 wherein said enhancing method further comprises quantizing said respective dither matrix threshold value to produce a quantized dither matrix threshold value ranging from 1 to q.

25. A medium as in claim 22 wherein said enhancing method further comprises generating said dither matrix, said dither matrix generating step comprising:

generating a dither matrix of dither-matrix locations that contain dither-matrix thresholds and are associated with respective subregion pixels of an image subregion by repeatedly assigning thresholds to the dither-matrix locations;

determining for each of a plurality of the subregion pixels the relative tightness thereto with which are clustered thereabout pixels that receive dots when the subregion presents a uniform gray-scale level that corresponds to the threshold being assigned;

identifying each subregion pixel for which the tightness thereby determined is greatest;

determining for each of a plurality of the subregion pixels thus identified the relative tightness thereto with which are clustered thereabout subregion pixels that have been assigned thresholds whose ranks is in a rank range that depends on the threshold being assigned and excludes some subregion pixels that receive dots when the subregion presents the uniform gray-scale level that corresponds to the threshold being assigned;

selecting at least one subregion pixel for which the tightness thereby determined is greatest; and assigning the threshold to a dither-matrix location associated with a subregion pixel thus selected.

26. A medium as in claim 21 wherein said enhancing method further comprises quantizing said intensity value representing a gray shade of said current pixel to produce said quantized pixel value p ranging from 1 to q.

27. A medium as in claim 21 wherein said enhancing method further comprises storing said quantization table in a shift register.

28. A medium as in claim 27 wherein said enhancing method further comprises shifting said quantiztion values in said quantization table circularly.

29. A medium as in claim 27 wherein said enhancing method further comprises storing said quantization values linearly in said quantization table.

30. A medium as in claim 21 wherein said enhancing method further comprises displaying said current pixel on a liquid crystal display (LCD).

31. A system for displaying a source image having a number of available gray shades represented by N bits per pixel on a display device having an M level gray shade display capability where M is less than $2^N$, comprising:

an input device for providing said source image;

a display device having a frame rate of q frames per display cycle:

a first comparator for comparing an intensity value representing a gray shade of a current pixel of said source image with a respective dither matrix threshold value and for providing a pixel on/off signal;

a quantization table for storing a plurality of quantization values ranging from 1 to q and for outputting p quantization values as active quantization values in accordance with a quantized pixel value p and for shifting said quantization values in said table in response to a frame signal;

a second comparator for comparing a quantized dither matrix threshold value to said active quantization values to produce an active quantized threshold signal;

a pixel out generator responsive to said pixel on/off signal and said active quantized threshold signal for producing a pixel out signal;

a display responsive to said pixel out signal for displaying said current pixel with an average gray value of p/q through a display period of q frames.

32. A system as in claim 31 wherein said input device is a scanner.

33. A system as in claim 31 wherein said input device is a personal computer.

34. A system as in claim 31 wherein said input device is a digital camera.

35. A system as in claim 31 wherein said input device is media.

36. A system as in claim 31 wherein said display device is a computer.

37. A system as in claim 31 wherein said display device is a projector.

38. A system as in claim 31 wherein said display is a liquid crystal display (LCD).

* * * * *